US007114704B1

(12) United States Patent
Suckow

(10) Patent No.: US 7,114,704 B1
(45) Date of Patent: Oct. 3, 2006

(54) STABILIZING DEVICE FOR A CARPET STRETCHER

(76) Inventor: John G Suckow, 1513 Lake Dr., Hubertus, WI (US) 53033

( * ) Notice: Subject to any disclaimer, the term of this patent is extended or adjusted under 35 U.S.C. 154(b) by 0 days.

(21) Appl. No.: 10/908,171

(22) Filed: Apr. 29, 2005

(51) Int. Cl.
*B25B 25/00* (2006.01)

(52) U.S. Cl. ..... 254/209; 254/200; 294/8.6

(58) Field of Classification Search ..... 254/200–212; 294/8.6
See application file for complete search history.

(56) References Cited

U.S. PATENT DOCUMENTS

| | | | | |
|---|---|---|---|---|
| 444,415 | A * | 1/1891 | Anderson | 254/211 |
| 3,963,216 | A | 6/1976 | Victor | 254/62 |
| 4,008,879 | A | 2/1977 | Youngman | 254/57 |
| 4,230,302 | A | 10/1980 | Crain, Jr. | 254/212 |
| 4,750,226 | A * | 6/1988 | Costill | 7/103 |
| 4,815,708 | A | 3/1989 | Samson | 254/212 |
| 5,129,696 | A | 7/1992 | Underwood | 294/8 |
| 5,145,225 | A | 9/1992 | Muller | 294/8 |
| 5,150,884 | A | 9/1992 | Hyer | 254/209 |
| 5,183,238 | A | 2/1993 | Sorensen | 254/209 |
| 5,364,143 | A | 11/1994 | Grady | 294/8 |
| 5,607,141 | A | 3/1997 | Clark | 254/200 |
| 5,681,031 | A | 10/1997 | Foley | 254/209 |
| 5,765,808 | A * | 6/1998 | Butschbacher et al. | 254/200 |
| 5,931,447 | A * | 8/1999 | Butschbacher et al. | 254/200 |
| 5,984,274 | A | 11/1999 | Medwin | 254/200 |
| 6,161,818 | A | 12/2000 | Medwin | 254/200 |
| 6,170,612 | B1 * | 1/2001 | Krumbeck | 187/200 |
| 6,371,446 | B1 | 4/2002 | Gauthier et al. | 254/201 |
| 6,669,174 | B1 | 12/2003 | Vito | 254/212 |

* cited by examiner

*Primary Examiner*—Emmanuel M Marcelo
(74) *Attorney, Agent, or Firm*—John K. McCormick

(57) ABSTRACT

A carpet stretcher is provided with the improvement of a stabilizing apparatus and method that attaches to a carpet stretching tool to prevent the carpet stretching tool and any of its additional stretcher tubes from bending or bowing when utilized to stretch carpeting during carpet installation. The stabilizing apparatus consists of a bar with appropriate means for attachment to a carpet stretcher.

7 Claims, 6 Drawing Sheets

STABILIZING DEVICE FOR A CARPET STRETCHER

BACKGROUND OF THE INVENTION

This invention relates to a carpet stretcher stabilizing device and to a carpet stretcher comprising such a device.

During the installation of carpet, carpet stretchers are often used to stretch the carpet to eliminate creases and wrinkles. It is common to attach one end of the carpet to a floor mounted wood strip, called a "tack strip", having embedded upwardly extending pins or short nails for engaging the carpet. The carpet is then laid out to the opposite side of the room and the carpet installer then utilizes a carpet stretcher to stretch out the carpet prior to securing the carpet to the opposite side of the room with additional tack strips.

Carpet stretchers, examples of which are well known in the art, typically comprise a tail block for bearing up against a wall, a head that has teeth for gripping a carpet, a shaft or piston member fixed to the head, a cylinder member within which the shaft is slidable, a variable number of interconnectable tubes (based upon the size of the carpet to be stretched) for connecting the cylinder member to the tail block, and a power unit for sliding the head relative to the cylinder member and longitudinally to the stretcher tubes. The power unit typically comprises a lever which is pivoted on the head and attached to the cylinder member by a pivotal link so that the head is forced forward when the lever is depressed. In this manner, the stretcher tubes serve to transmit the forces in use to stretch the carpet.

A disadvantage of the known carpet stretchers is that the stretcher tubes are resiliently flexible and consequently tend to bow sideways during operation, as shown in FIG. 2, thereby reducing the effectiveness of the stretching operation and of the forces being transmitted to the carpet.

In has heretofore been proposed to immobilize the stretcher tubes by attaching to the stretcher tubes a carpet gripper which has teeth or the like for gripping the carpet surface or having an addition brace kit as describe in U.S. Pat. No. 4,815,708 issued to Samson on March 28$^{th}$, 1989. Both proposals have the potential for damaging the carpet if there is any deflection of the stretcher tubes when in use. In addition, the second proposal can be costly and time consuming in applying the additional brace kits for use.

Accordingly, it is believed to be advantageous to provide a less costly means for better stabilizing the stretcher tubes of a carpet stretcher that does not have the potential for damaging the carpet being stretched.

SUMMARY OF THE INVENTION

A first aspect the present invention is directed to an apparatus for stabilizing a carpet stretcher from bending or bowing horizontally to the floor or surface being carpeted thereby making maximum effective use of the stretching forces on the carpet. In a first embodiment, the stabilizing bar consists of a flat rectangular bar of a light weight but rigid material such as aluminum or the like. Attached to this bar are clips for securing the bar to the carpet stretcher or stretcher tube attachments.

In a second embodiment, the stabilizing bar is fixedly attached to the carpet stretcher and any additional stretcher tubes that may be employed in stretching carpet during installation. This allows for the quick addition or removal of additional carpet stretching tubes with the stabilizer bars already attached.

In a third embodiment the stabilizing bar is an angular bar that provides bending stability in both horizontal and vertical planes to the floor or surface being carpeted. Other shapes of the stabilizer bar, such as square tubing or the like could be utilized and not detract from the intent and scope of the invention.

In a fourth embodiment the stabilizer is substantially longer than any single additional stretcher tube and the stabilizer bar is hinged in a plurality of places. This allows the stabilizer bar to remain folded when attached to a carpet stretcher used in a short carpet laying space and unfolded and attached to multiple carpet stretcher tubes being used by a single carpet stretcher when there is a large carpet to be laid and stretched. In addition, the carpet stretcher stabilizer can be folded up for compact storage and transportation when not in use.

DETAILED DESCRIPTION OF THE INVENTION

Figure 1:
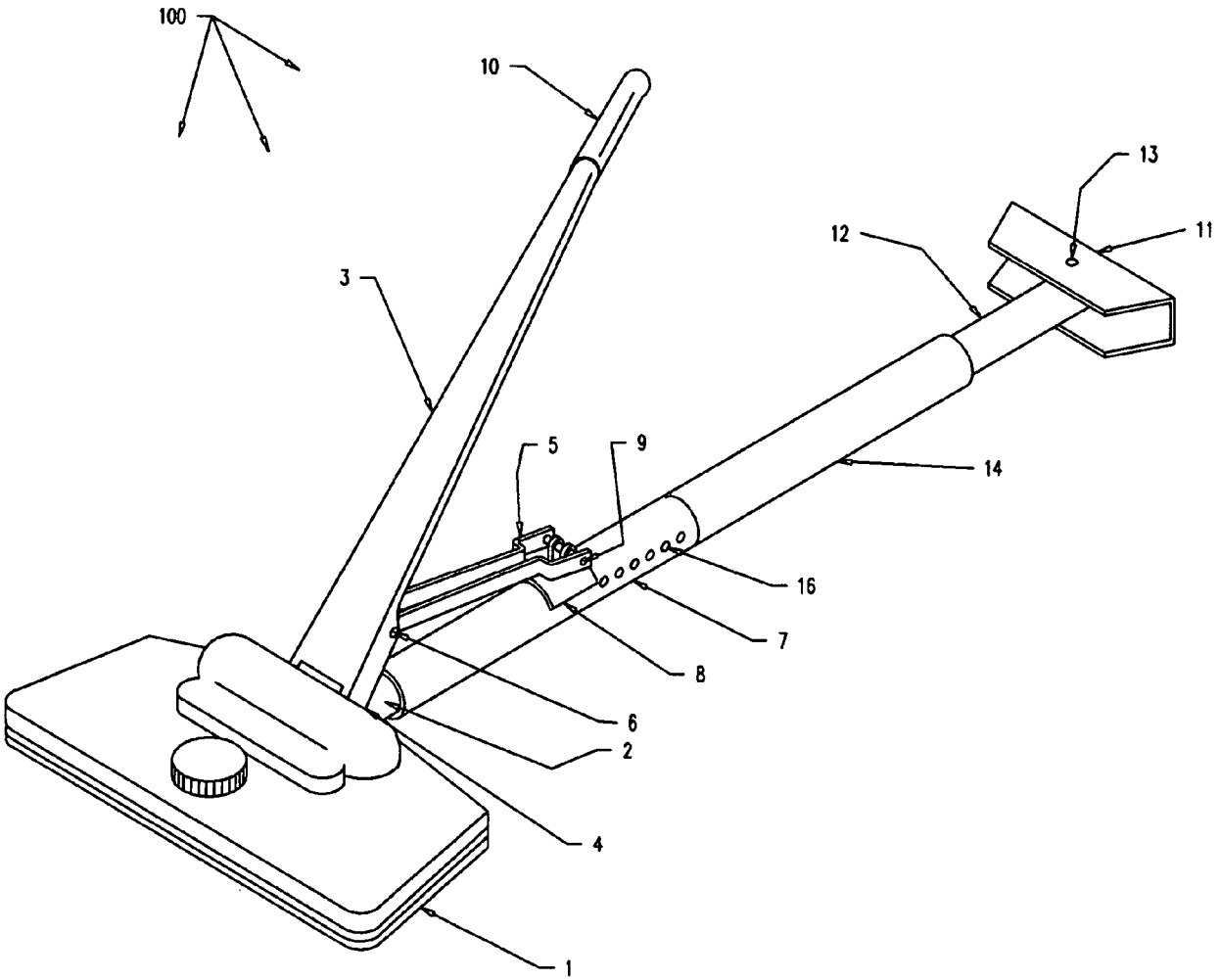
Fig. 1 Prior Art
FIG. 1 is a schematic plan view of a conventional carpet stretcher.

Reference will now be made in detail to the description of the invention as illustrated in the drawings. Although the invention will be described in connection with these drawings, there is no intent to limit the invention to the embodiment or embodiments disclosed therein. On the contrary, the intent is to include all alternatives, modifications and equivalents included within the spirit and scope of the invention as defined by the appended claims.

FIG. 1 shows a hand powered carpet stretcher 100 that comprises a head 1 having teeth (not shown) which engage the carpet and a shaft 2 which is fixed to the head 1. A lever 3 is pivotally attached to the head 1 by a pin 4 and has a handle 10. The lever 3 is pivotally connected to a link member 5 by a second pin 6. The opposite end of the link member 5 is pivotally connected to a base member 7 by a bracket 8 and a third pin 9.

The cylinder member 7 supports the bracket 8 and slidably receives the shaft 2. A tail block 11 is attached to a short tube 12 by a pin 13. The short tube 12 can be used to engage additional stretcher tubes 14 between the short tube 12 and the base member 7 in order to lengthen the carpet stretcher.

The base member 7 comprises a cylinder member which mates with the stretcher tubes 14 commonly used in carpet stretcher assemblies. The stretcher tubes 14 typically have one male end and one female end such that multiple stretcher tubes 14 can be used together. The number of additional stretcher tubes 14 utilized is dependant upon the size of the carpet to be stretched. The means of assembling them and securing them together are well known in the art. Any suitable materials and securing mechanisms may be utilized in the construction of the carpet stretcher.

Figure 2:
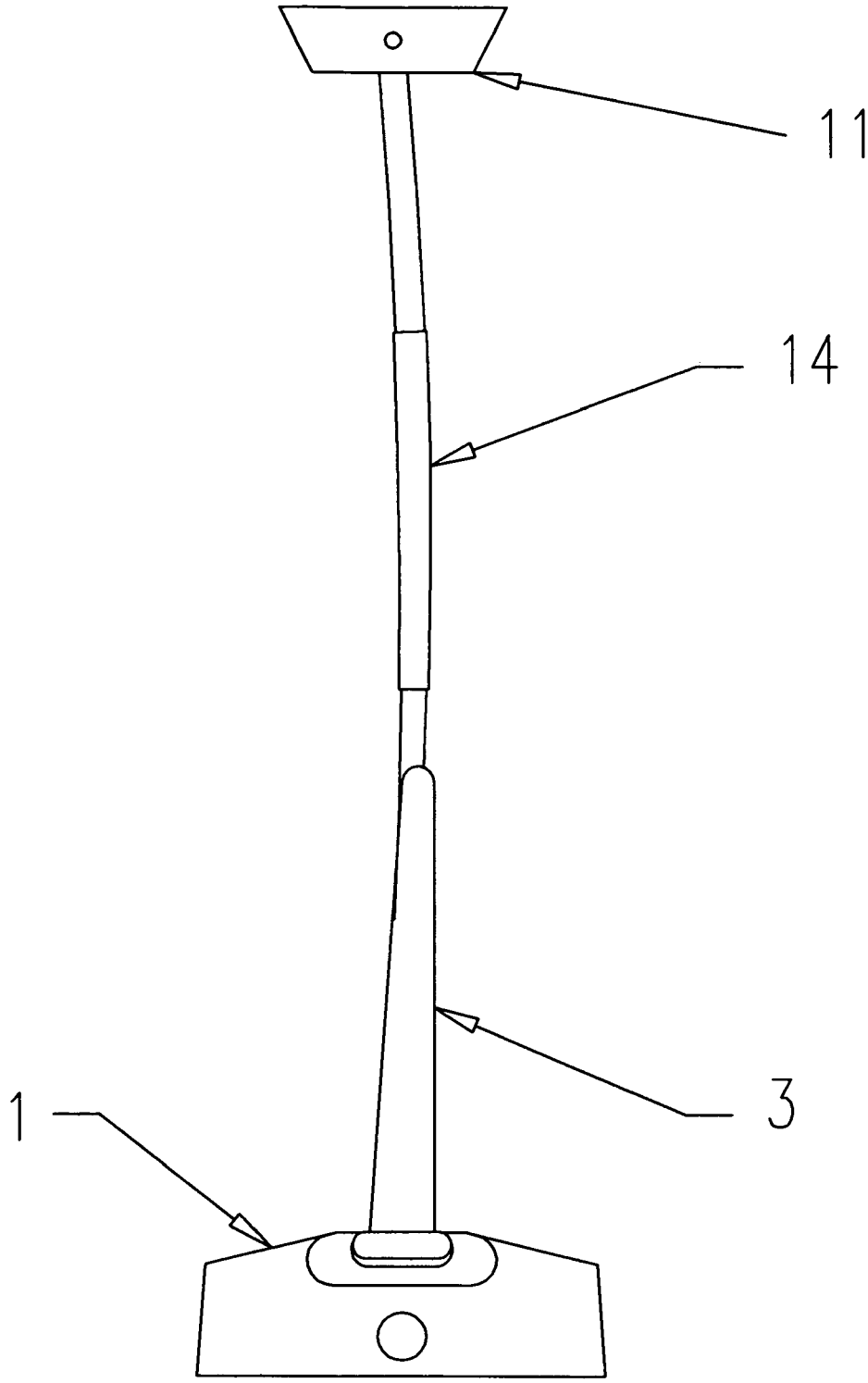
Fig. 2 Prior Art
FIG. 2 is a schematic plan view of a conventional carpet stretcher in use.

FIG. 2 illustrates the conventional carpet stretcher of FIG. 1 in use, showing the undesirable side-to-side arcing of the stretcher tubes. This arcing reduces the effective carpet stretching force. According to the invention, this problem is overcome by attaching a stabilizer bar as will be described hereinbelow with reference to FIGS. 3, 4, 5 and 6.

Figure 3:
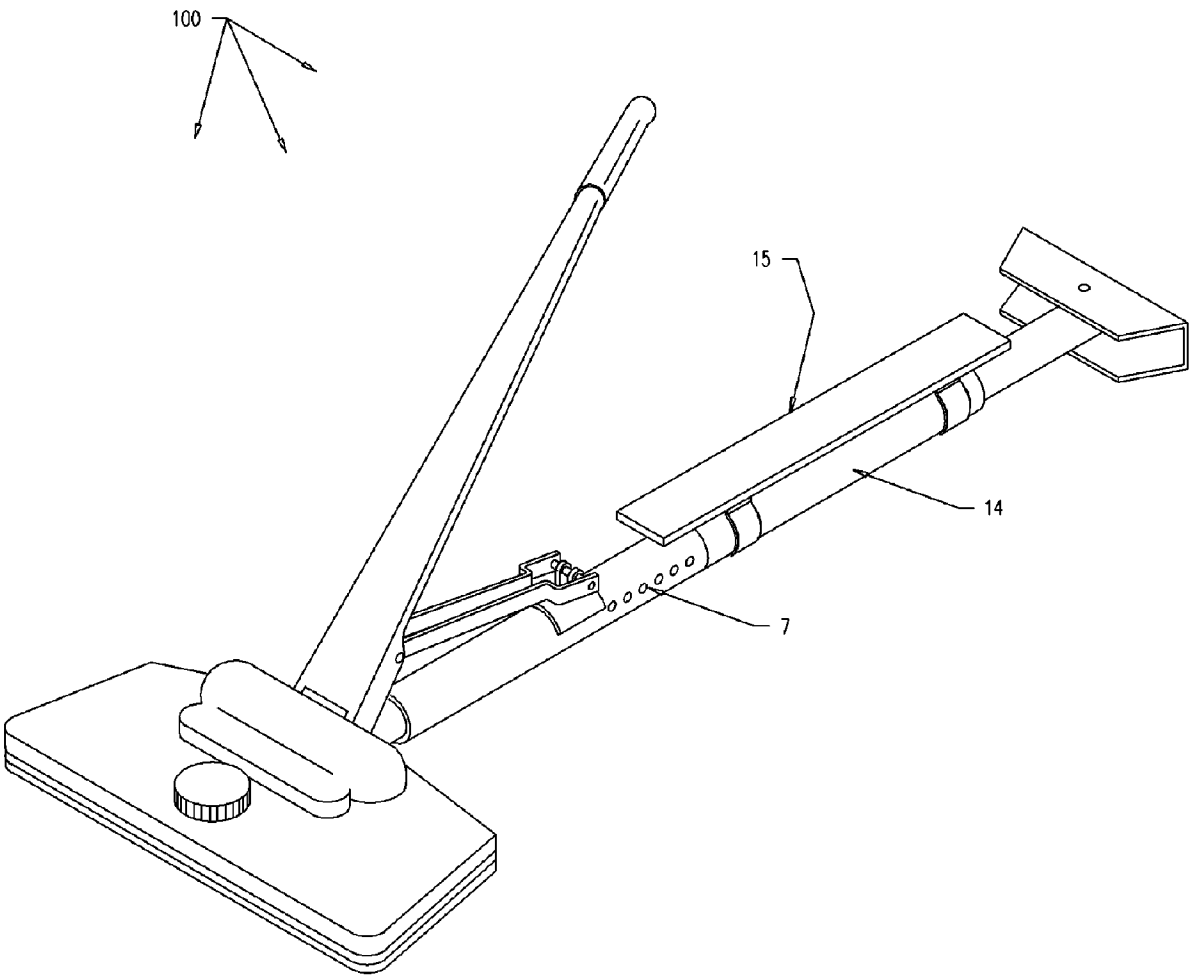
FIG. 3 is a perspective view of a conventional carpet stretcher which is suitable for use with an attached stabilizing device according to the invention.
Figure 4:
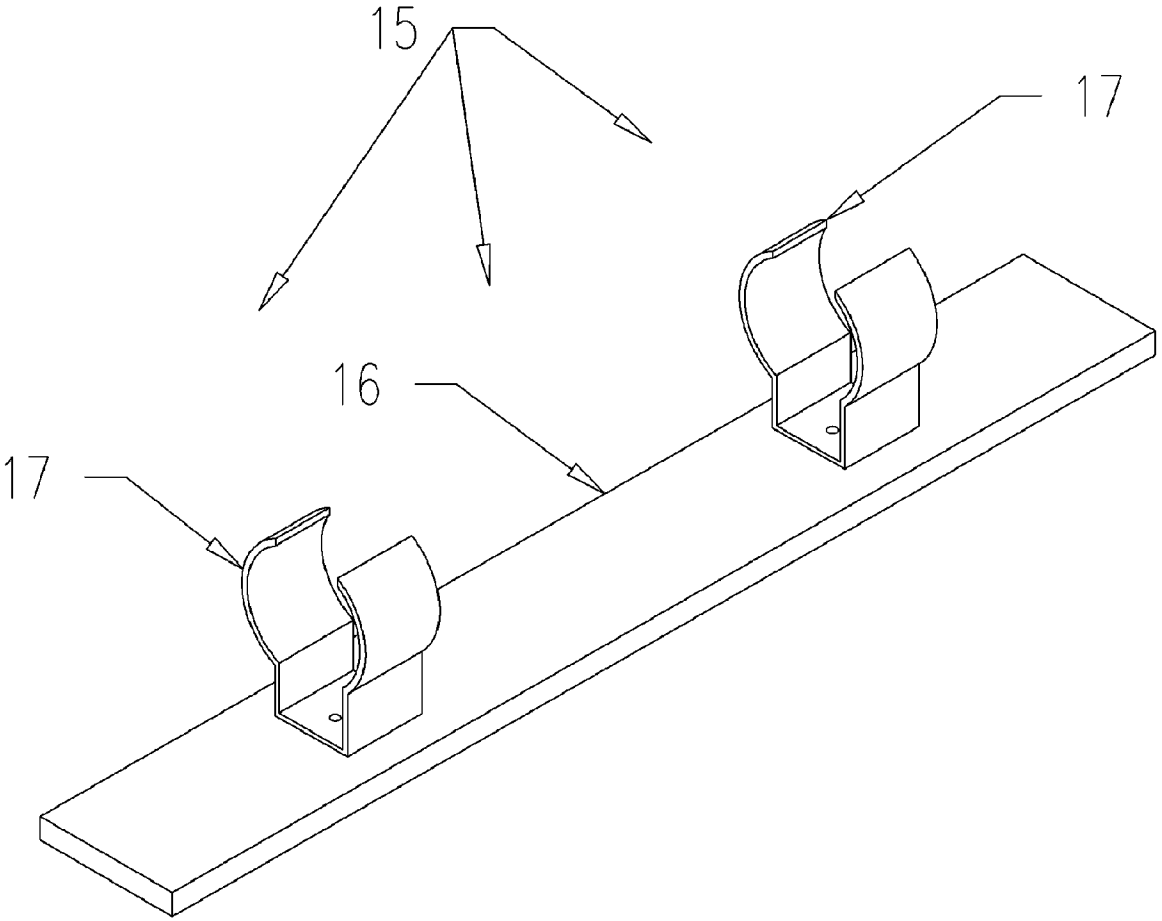
FIG. 4 is a perspective view of the underside of the stabilizer bar in one of its embodiments.

FIG. 3 shows the carpet stretcher 100 of FIG. 1 with a stabilizer bar 15 attached to the top of the carpet stretcher tubes 14 and/or the base member 7. FIG. 4 shows a perspective view of the underside of the stabilizer bar 15. In one embodiment, the stabilizer bar 15 consists of a rectangular bar 16 of a light weight and stiff material, such as aluminum or the like. Fixedly attached to the bar 16 are a plurality of clips 17. In operation, the bar 16 with the attached clips 17 are snapped over the top of the stretcher tubes 14. As the bar 16 is much wider than it is thick, the bar 16 prevents the stretcher tubes 14 from flexing on a horizontal plane with the floor.

Figure 5:
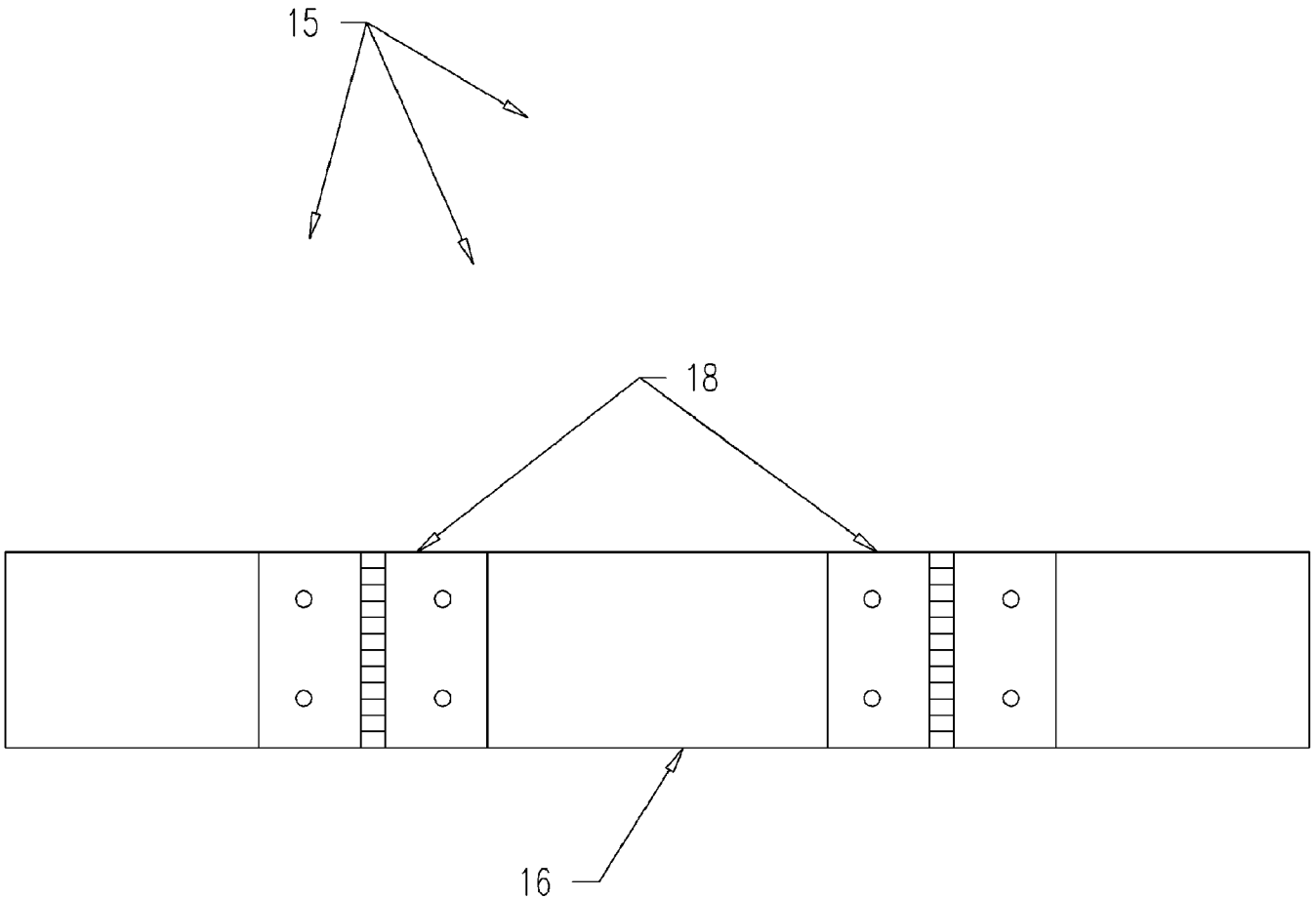
FIG. 5 is a plan view of the top of the stabilizer bar with hinges.

In an alternative embodiment depicted in FIG. 5, the top of the stabilizer bar 15 can have a single or a plurality of hinges 18 along the length of the bar 16 in order to accommodate varying numbers of stretcher tubes and for compact storage when not in use.

Figure 6:
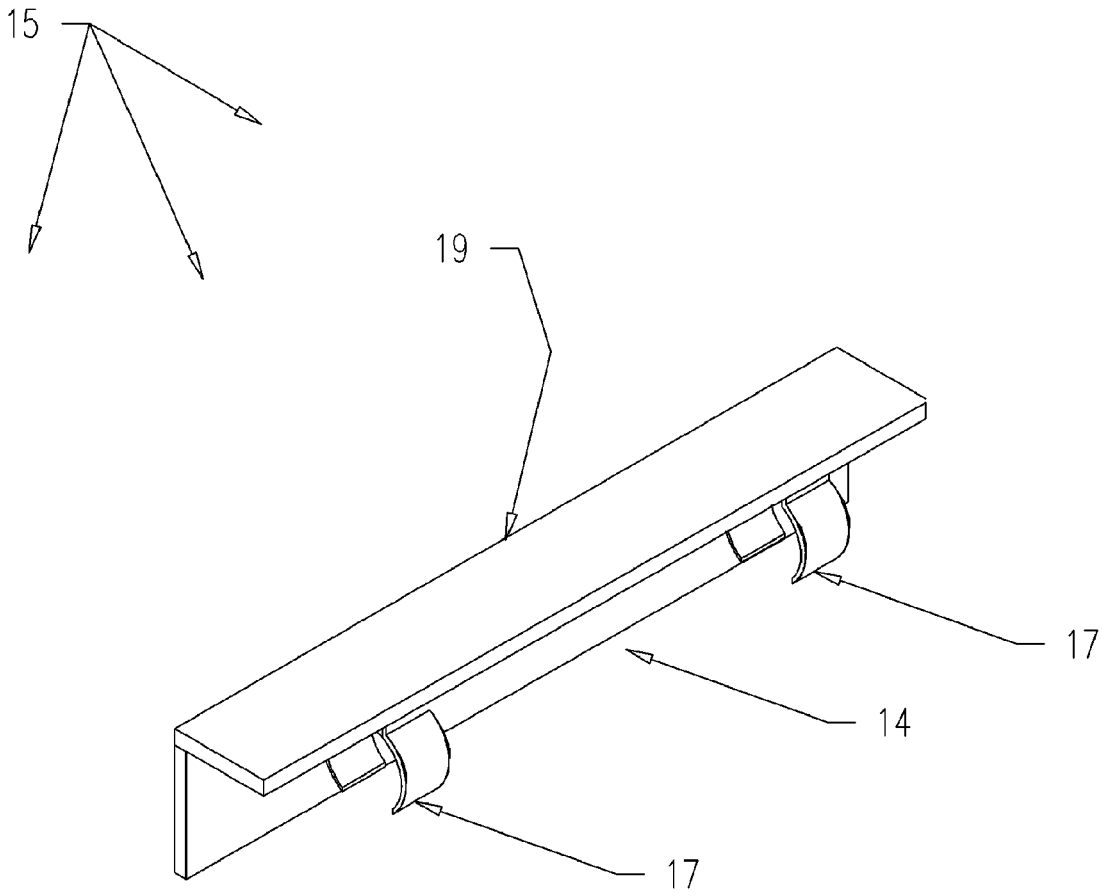
FIG. 6 is a perspective view of a second embodiment of the stabilizer bar.

In another embodiment of the invention, shown in FIG. 6, the flat rectangular bar 16 is replaced with an angular bar 19. In this embodiment, the clips 17 are also used to attach the stabilizing bar to the carpet stretcher. The angular bar 19 could also be hinged to provide for more compact storage. The angular bar prevents the stretcher tubes from flexing in both a horizontal and vertical plane to the floor.

In another embodiment, the stabilizing bar, either rectangular 16 or angular 19 can be permanently affixed to the stretcher tubes 14 in lengths roughly equal to the stretcher tube lengths. Thus, as stretcher tubes 14 are added to the carpet stretcher, the stabilizer bars are already attached to prevent flexing of the stretcher tubes 14.

What is claimed is:

1. In a carpet stretcher comprising a tail stock for bearing against a wall, a head for gripping a carpet surface, axially aligned carpet stretcher tubes adapted for connection to said tail stock and a power unit connected to said head and said carpet stretcher tube wherein multiple carpet stretcher tubes can be axially interconnected to increase the overall length of the carpet stretcher, the improvement consisting of a flat rigid rectangular stabilizer bar with a plurality of spring clips fixedly attached to said stabilizer bar, said spring clips removably snap onto said carpet stretcher tubes holding the stabilizer bar to said stretcher tubes in a longitudinally extending relationship parallel and immediately next to said carpet stretcher tubes preventing said carpet stretcher tubes from bowing when stretching carpeting.

2. The improvement according to claim 1, wherein said stabilizer bar is an angular bar attached by said clips to said carpet stretcher tubes in a longitudinally extending relationship parallel and immediately next to said carpet stretcher tubes preventing said carpet stretcher tubes from bowing when stretching carpeting.

3. In a carpet stretcher comprising a tail stock for bearing against a wall, a head for gripping a carpet surface, axially aligned carpet stretcher tubes adapted for connection to said tail stock and a power unit connected to said head and said carpet stretcher tube wherein multiple carpet stretcher tubes can be axially interconnected to increase the overall length of the carpet stretcher, the improvement consisting of a flat rigid rectangular stabilizer bar with a plurality of spring clips fixedly attached to said stabilizer bar, said spring clips removably snap onto said carpet stretcher tubes holding the stabilizer bar to said stretcher tubes in a longitudinally extending relationship parallel and immediately next to said carpet stretcher tubes preventing said carpet stretcher tubes from bowing when stretching carpeting, wherein said stabilizer bar is hinged in one or more places to allow said stabilizer bar to be opened or folded up to the appropriate length for a given carpet length to be laid and stretched.

4. A carpet stretcher and stabilizer comprising:

a tail stock for bearing against a wall;

a head for gripping a carpet surface;

a piston member affixed to said head;

a cylinder member within which said piston member is slidable;

a lever member pivotally connected to said head for pivoting about a first axis;

a link member pivotally connected about a second axis which is spaced from said first axis, the link member being pivotable with respect to said cylinder member about a third axis which is spaced from said second axis, whereby said piston member is slidable relative to said cylinder member by pivoting said lever member;

at least one tubular connecting member for connecting said cylinder to said tail stock; and a stabilizer bar that is removably connected to said tubular connecting member in a longitudinally extending relationship parallel and immediately next to said carpet stretcher tubes preventing said carpet stretcher tubes from bowing when stretching carpeting, wherein said removable stabilizer bar is hinged in at least one location over the length of said stabilizer bar to allow said stabilizer bar to be folded up when not required or when in transportation or storage.

5. A means for stabilizing a carper stretcher from bending forces comprising:

a flat stabilizer bar means with clip means fixedly attached to said stabilizer bar means;

said clip means being removably snapped into place about a carpet stretcher's tubes in a longitudinally extending relationship parallel and immediately next to said carpet stretcher tubes preventing said carpet stretcher tubes from bowing when stretching carpeting.

6. The means of claim 5 wherein said flat stabilizer bar means is an angular stabilizer bar means.

7. A means for stabilizing a carper stretcher from bending forces comprising:

a flat stabilizer bar means with clip means fixedly attached to said stabilizer bar means;

said clip means being removably snapped into place about a carpet stretcher's tubes in a longitudinally extending relationship parallel and immediately next to said carpet stretcher tubes preventing said carpet stretcher tubes from bowing when stretching carpeting wherein said stabilizer bar means provide a means for folding up when not in use.

* * * * *